US009811029B2

(12) United States Patent
Honda et al.

(10) Patent No.: US 9,811,029 B2
(45) Date of Patent: Nov. 7, 2017

(54) FIXING DEVICE AND IMAGE FORMING APPARATUS INCLUDING THE SAME

(71) Applicants: Haruyuki Honda, Kanagawa (JP); Ryuuichi Mimbu, Kanagawa (JP); Yoshio Hattori, Kanagawa (JP); Yoshiki Yamaguchi, Kanagawa (JP); Toshihiko Shimokawa, Kanagawa (JP)

(72) Inventors: Haruyuki Honda, Kanagawa (JP); Ryuuichi Mimbu, Kanagawa (JP); Yoshio Hattori, Kanagawa (JP); Yoshiki Yamaguchi, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/073,800

(22) Filed: Mar. 18, 2016

(65) Prior Publication Data

US 2016/0274509 A1 Sep. 22, 2016

(30) Foreign Application Priority Data

Mar. 20, 2015 (JP) ..... 2015-058164

(51) Int. Cl.
*G03G 15/20* (2006.01)
*G03G 15/00* (2006.01)

(52) U.S. Cl.
CPC ..... *G03G 15/2028* (2013.01); *G03G 15/6576* (2013.01); *G03G 2215/00662* (2013.01);
(Continued)

(58) Field of Classification Search
CPC ..... G03G 15/6576; G03G 15/2028; G03G 2215/2035; G03G 2215/00662
See application file for complete search history.

(56) References Cited

U.S. PATENT DOCUMENTS

2009/0311015 A1* 12/2009 Nakayama ..... G03G 15/2025 399/327
2011/0064502 A1* 3/2011 Hase ..... G03G 15/2053 399/406

(Continued)

FOREIGN PATENT DOCUMENTS

| | | |
|---|---|---|
| JP | 9-188456 | 7/1997 |
| JP | 2001-048399 | 2/2001 |
| JP | 2012-091891 | 5/2012 |

*Primary Examiner* — Sevan A Aydin
(74) *Attorney, Agent, or Firm* — Harness, Dickey & Pierce, P.L.C.

(57) ABSTRACT

A fixing device has a flexible endless fixing member; a heater to heat the fixing member; a nip forming member to contact the fixing member directly or via a slide member; a pressure member, rotatably disposed opposite the fixing member and the nip forming member; and a back curl correction structure that includes a drive roller disposed on a side where a back curl appears in the recording sheet; a driven roller disposed opposite the drive roller; an auxiliary nip portion to feed the recording sheet; a guide member to guide the recording sheet fed out from the auxiliary nip portion to bend in a direction opposite a curled direction of the back curl of the recording sheet. A driving connection between the drive roller and the pressure member is performed by a connection between a drive roller side connection gear and a pressure member side connection gear.

8 Claims, 8 Drawing Sheets

(52) U.S. Cl.
CPC ..... *G03G 2215/0132* (2013.01); *G03G 2215/2035* (2013.01)

(56) References Cited

U.S. PATENT DOCUMENTS

2014/0374987 A1* 12/2014 Uehara ..... B65H 29/70 271/264
2015/0316877 A1* 11/2015 Okuda ..... G03G 15/2028 399/322
2015/0362875 A1* 12/2015 Ono ..... B65H 5/068 399/322
2016/0274508 A1* 9/2016 Honda ..... G03G 15/2028

* cited by examiner

FIXING DEVICE AND IMAGE FORMING APPARATUS INCLUDING THE SAME

CROSS-REFERENCE TO RELATED APPLICATION

The present application claims priority pursuant to 35 U.S.C. §119(a) from Japanese patent application number 2015-058164, filed on Mar. 20, 2015, the entire disclosure of which is incorporated by reference herein.

BACKGROUND

Technical Field

The present invention relates to a fixing device and an image forming apparatus employing electrophotography such as a copier, a printer, or a facsimile machine.

Background Art

In general, a fixing device in an image forming apparatus includes a heat roller and a pressure roller that press against each other to form a fixing nip. A recording sheet on which a toner image is transferred is conveyed to the fixing device, and in the fixing nip, the recording sheet is heated while being pressed against a circumferential surface of the heat roller by the pressure roller, and the toner image is thermally fixed onto the recording sheet.

In such a thermal fixation, because there is a difference in temperature between the heat roller and the pressure roller, it causes a temperature difference between the front and back of the recording sheet, that is, a surface opposite the heat roller and a back surface opposite the pressure roller, when the recording sheet passes through the fixing nip. Specifically, the surface of the recording sheet contacting the heat roller shows a higher temperature than the back of the recording sheet contacting the pressure roller.

As a result, after passing through the fixing nip, more of the moisture contained in the recording sheet evaporates from the front surface of the recording sheet than from the back, and the moisture moves from the back to the front side. As a result, extension of fiber member in the front side increases, so that the recording sheet curls backward (which is called a back curl).

In contemporary fixing devices having a low-thermal heater for energy reduction and accelerating warm-up period, feeding of the sheet becomes ready before the pressure roller is sufficiently warmed, resulting in a large difference in the temperature of the heat roller and the pressure roller. With such a structure, a large back curl is generated in the fixing device due to a large difference in the temperature of the front side and the back of the sheet during fixation. In such a fixing device, when the recording sheet is ejected with a large back curl, the defined number of recording sheets cannot be stacked on a sheet tray, or alternatively, the stacked sheets in the tray are messed up.

SUMMARY

In one exemplary embodiment, provided is an optimal fixing device including a flexible endless fixing member; a heater to heat the fixing member; a nip forming member to contact the fixing member directly or via a slide member; a pressure member, rotatably disposed opposite the fixing member and the nip forming member, to press the fixing member to thereby form a fixing nip portion together with the nip forming member, wherein the fixing device fixes an image in the fixing nip portion with heat and pressure onto a recording sheet; and a back curl correction structure disposed downstream of and adjacent to the fixing nip portion in a recording sheet feeding direction. The back curl correction structure includes a drive roller disposed on a side where a back curl appears in the recording sheet; a driven roller disposed opposite the drive roller; an auxiliary nip portion between the drive roller and the driven roller to feed the recording sheet; and a guide member disposed at the same side as the drive roller relative to the auxiliary nip portion to guide the recording sheet fed out from the auxiliary nip portion to bend in a direction opposite a curled direction of the back curl of the recording sheet. The fixing device further includes a drive roller side connection gear to input a rotary driving force to a rotary shaft of the drive roller; and a pressure member side connection gear to branch and output the rotary driving force of the pressure member, and a driving connection between the drive roller and the pressure member is performed by a connection between the drive roller side connection gear and the pressure member side connection gear.

Another exemplary embodiment is an image forming apparatus incorporating the fixing device as described above.

These and other features and advantages of the present invention will become apparent upon consideration of the following description of the preferred embodiments of the present invention when taken in conjunction with the accompanying drawings.

DETAILED DESCRIPTION

Figure 1:
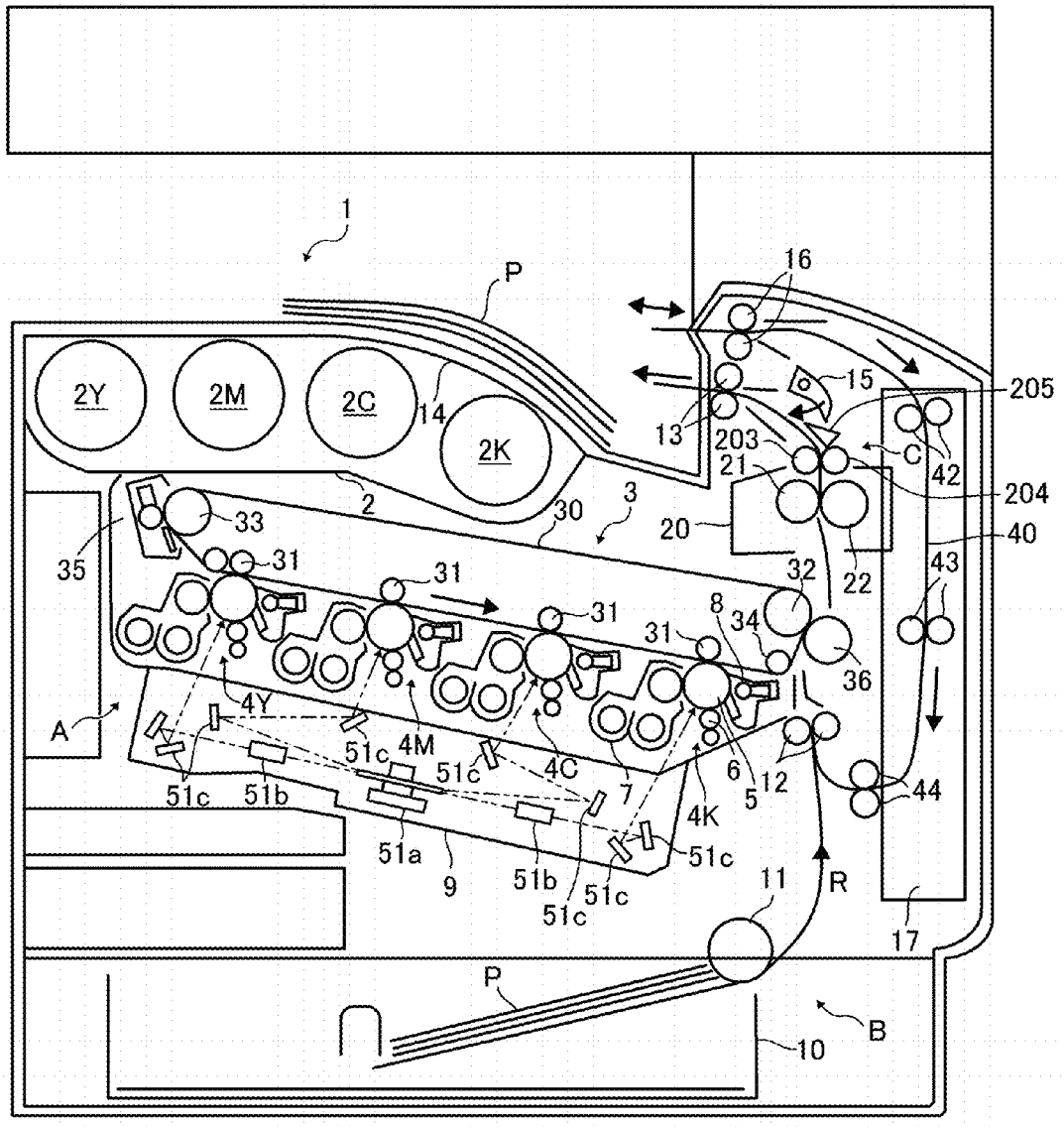
FIG. 1 schematically illustrates an image forming apparatus including a fixing device having a back curl correction structure according to one embodiment of the present invention.

Hereinafter, preferred embodiments of a fixing device and an image forming apparatus to which the present invention is applied will be described referring to the accompanying drawings.

First, a general configuration of an image forming apparatus according to an embodiment of the present invention will be described.

In the present embodiment, the image forming apparatus 1 is a color laser printer, and includes an image forming section A, a sheet feed section B, a fixing device 20, a pair of sheet ejection rollers 13, a sheet ejection tray 14, a pair of reverse rollers 16, and a duplex unit 17.

The image forming section A includes four image forming units 4Y, 4M, 4C, and 4K, an exposure device 9, and a transfer device 3. The fixing device 20 of the present image forming apparatus 1 includes a back curl correction structure C, of which details will be described.

The image forming apparatus 1 includes four image forming units 4Y, 4M, 4C, and 4K disposed in the center of the apparatus. Each of the image forming units 4Y, 4M, 4C, and 4K has the same structure except that each includes a different color of developer such as yellow (Y), magenta (M), cyan (C), and black (K) that corresponds to RGB color separation component of a color image.

Specifically, each image forming unit 4Y, 4M, 4C, or 4K includes a drum-shaped photoconductor 5 as a latent image bearer; a charger 6 to charge a surface of the photoconductor 5; a developing device 7 to supply toner on the surface of the photoconductor 5; and a cleaning device 8 to clean the surface of the photoconductor 5. In FIG. 1, only the photoconductor 5, the charger 6, the developing device 7, and the cleaning device 8 that the black image forming unit 4K includes are applied with a reference numeral and reference numerals for other image forming units 4Y, 4M, and 4C are omitted, because all image forming units are similarly constructed.

An exposure device 9 to expose the surface of the photoconductor 5 is disposed underneath the image forming units 4Y, 4M, 4C, and 4K. The exposure device 9 includes a laser light source, a polygonal mirror 51*a*, fθ lenses 51*b*, a plurality of reflection mirrors 51*c*, and the like, and is configured to irradiate each surface of the photoconductor 5 with laser beams based on image data, to thereby form an electrostatic latent image on the surface of the photoconductor 5.

A transfer device 3 is disposed above each of the image forming units 4Y, 4M, 4C, and 4K. The transfer device 3 includes an intermediate transfer belt 30 as an intermediate transfer member; four primary transfer rollers 31 as primary transfer members; a secondary transfer backup roller 32; a cleaning backup roller 33; a tension roller 34; and a belt cleaning device 35.

The intermediate transfer belt 30 is an endless belt stretched around the secondary transfer backup roller 32, the cleaning backup roller 33, and the tension roller 34. When the secondary transfer backup roller 32 rotates, the intermediate transfer belt 30 is driven to rotate in the direction indicated by an arrow in the figure.

The four primary transfer rollers 31 each are disposed at a position opposed to each photoconductor 5 with the intermediate transfer belt 30 sandwiched in between, thereby forming a primary transfer nip. In addition, each primary transfer roller 31 is connected with a power source and a predetermined direct current (DC) voltage or alternating current (AC) voltage is applied to each primary transfer roller 31.

The secondary transfer roller 36 sandwiches the intermediate transfer belt 30 together with the secondary transfer backup roller 32 so as to form a secondary transfer nip. In addition, similarly to the primary transfer rollers 31, the secondary transfer roller 36 is connected to a power source, and a predetermined direct current (DC) voltage or alternating current (AC) voltage is applied to the secondary transfer roller 36.

The belt cleaning device 35 includes a cleaning brush and a cleaning blade which are so disposed as to contact the intermediate transfer belt 30. Waste toner collected by the belt cleaning device 35 is conveyed via a waste toner conveying hose, and is contained therein.

A bottle holder 2 is disposed in an upper part of the image forming apparatus. Four toner bottles 2Y, 2M, 2C, and 2K each containing toner for replenishment are detachably mounted to the bottle holder 2. A supply path is disposed between each toner bottle 2Y, 2M, 2C, or 2K and each developing device 7. Toner is supplied to each developing device 7 from a corresponding toner bottle 2Y, 2M, 2C, or 2K.

The sheet feed section B is disposed in the bottom of the image forming apparatus. The sheet feed section B includes a sheet tray 10 in which a recording sheet P as a recording medium is contained, and a sheet feed roller 11 to feed the recording sheet P from the sheet tray 10.

In addition to a regular sheet, the recording medium is defined to include various sheets such as cardboard, a postcard, an envelope, thin paper, coated paper or art paper, tracing paper, an OHP sheet, and the like. A manual sheet feeder may be disposed in the image forming apparatus. in the present embodiment, the term "cardboard" means paper having a basis weight of 160 grams/$m^2$ or more.

Further, a feeding path R through which the recording sheet P is fed from the sheet tray 10 to an outside the apparatus via the secondary transfer nip is disposed inside a body 100 of the image forming apparatus 1. A pair of registration rollers 12 serving as a timing roller to feed the sheet P to the secondary transfer nip at an appropriate timing is disposed upstream in the sheet feeding direction of the secondary transfer roller 36 in the feeding path R.

The fixing device 20 presses and heats the recording sheet P on which an unfixed image is borne and thereby fixes the toner image onto the recording sheet P. The fixing device 20 is disposed downstream in the recording sheet feeding direction than the position of the secondary transfer roller 36. Further, a pair of sheet ejection rollers 13 to eject the recording sheet P outside the body of the apparatus is disposed downstream of the fixing device 20 in the sheet feeding direction of the feeding path R. In addition, a sheet ejection tray 14 to stock the sheet ejected outside the apparatus is disposed on an upper surface of the body of the apparatus.

Further, a branching member 15 is disposed between the sheet ejection rollers 13 and the fixing device 20. The branching member 15 is rotatably fixed to the body, coming to be at a first state as illustrated in FIG. 1 in a one-side printing mode, and turning out to be at a second state closing in a direction indicated by an arrow from the first state in a duplex printing mode.

Specifically, the branching member 15 forms a recording sheet conveyance path branching device of the present invention, because the branching member 15 serves to switch an outside ejection path, a path passing the sheet ejection rollers 13, to eject the recording sheet P conveyed downstream of the fixing device 20 to the sheet ejection tray 14 disposed outside the apparatus to a reversing path, a path inside the duplex unit 17 to be described later, of the duplex printing. Further, a back curl correction structure C, which will be described later, is disposed between the branching member 15 and the fixing device 20.

The duplex reversing path 40 includes a reverse roller 16 to switch back the recording sheet P disposed downstream of the branching member 15, and a duplex unit 17 disposed between the reverse roller 16 and the registration rollers 12. The duplex unit 17 forms a reversing path of the duplex printing, including feed rollers 42 to 44, allows the reverse roller 16 to switch back the recording sheet P, a first side of which has been fixed, and feeds the recording sheet P to the registration rollers 12 via the feed rollers 42 to 44.

Next, a basic operation of the image forming apparatus 1 according to an embodiment of the present invention will be described.

When an image forming operation is started, each photoconductor 5 of each of the image forming units 4Y, 4M, 4C, and 4K is driven to rotate clockwise as illustrated in FIG. 1, and each surface of the photoconductor 5 is uniformly charged at a predetermined polarity by the charger 6. An exposure device 9 irradiates laser beams to the charged surface of each photoconductor 5 and an electrostatic latent image is formed on the surface of each photoconductor 5.

In this case, the image data exposed on each photoconductor 5 is monochrome image data decomposed, from the target full-color image, into color data of yellow, magenta, cyan, and black. Each developing device 7 supplies toner to the electrostatic latent image formed on the photoconductor 5, and the electrostatic latent image is rendered visible as a toner image.

When the image forming operation is started, the secondary transfer backup roller 32 rotates counterclockwise and the intermediate transfer belt 30 is driven to rotate in the direction indicated by an arrow in the figure.

In addition, because the constant voltage or the constant-current controlled voltage with a polarity opposite that of the toner is applied to each of the primary transfer rollers 31, a transfer electric field is formed in the primary transfer nip between each of the primary transfer rollers 31 and each photoconductor 5.

Thereafter, upon the toner image of each color formed on the photoconductor 5 reaching the primary transfer nip along with the rotation of each photoconductor 5, the toner image of each color formed on each photoconductor 5 is sequentially transferred in a superimposed manner on the intermediate transfer belt 30 by the transfer electric field formed in the primary transfer nip.

Thus, a full-color toner image is borne on the surface of the intermediate transfer belt 30. In addition, the residual toner which has not been transferred to the intermediate transfer belt 30 and is remaining on each photoconductor 5 is removed by the cleaning device 8. Thereafter, the surface of each photoconductor 5 is neutralized by a discharger and the surface potential is initialized.

The sheet feed roller 11 disposed in the bottom of the printer is started to rotate so that the recording sheet P is fed out from the sheet tray 10 to the feeding path R. The recording sheet P fed out to the feeding path R is once stopped by the registration rollers 12.

Then, the registration rollers 12 start to rotate at a predetermined timing and feeds the recording sheet P to the secondary transfer nip at a timing matched with which the image on the intermediate transfer belt 30 arrives at the secondary transfer nip. In this case, because the transfer voltage having a polarity opposite that of the charged toner of the toner image on the intermediate transfer belt 30 is applied to the secondary transfer roller 36, a transfer electric field is formed at the secondary transfer nip. Through the electric transfer field, the toner image on the intermediate transfer belt 30 is transferred en bloc to the recording sheet P. In addition, the residual toner, that has not been transferred to the recording sheet P and is remaining on the intermediate transfer belt 30, is removed by a belt cleaning device 35 and is conveyed to and collected in a waste toner container.

Thereafter, the sheet P is conveyed to the fixing device 20, and the toner image on the sheet P is fixed by the fixing device 20 onto the recording sheet P. The branching member 15 switches a path to eject the recording sheet P to outside the apparatus and the duplex reversing path. The recording sheet P conveyed from the fixing device 20 passes through the branching member 15 and is guided to the ejection direction or re-feed direction.

In the one-side printing mode, the branching member 15 is open so that the recording sheet P is conveyed outside the apparatus by the pair of sheet ejection rollers 13, and is ejected onto the sheet ejection tray 14 to stock the recording sheet P, disposed on the upper face of the body of the image forming apparatus.

In the duplex printing mode, the branching member 15 closes in the direction indicated by the arrow, so that the recording sheet P after the first side has been fixed is guided to the duplex reversing path 40. The recording sheet P guided to the duplex reversing path 40 is switched back and is conveyed to the duplex unit 17, and is again conveyed and re-fed to the pair of registration rollers 12, and the image to be printed on the second side is printed on the back thereof similarly to the first side. The recording sheet P is then ejected outside the apparatus by the sheet ejection rollers 13, and is stocked on the sheet ejection tray 14.

The explanation heretofore relates to an image forming operation when a full-color image is formed on the recording sheet P; however, a monochrome image may be formed using any one of the four image forming units 4Y, 4M, 4C, and 4K and an image formed of two or three colors may be possible by using two or three image forming units.

Next, the fixing device 20 including a back curl correction structure C of the image forming apparatus 1 will be described in detail.

Figure 2:
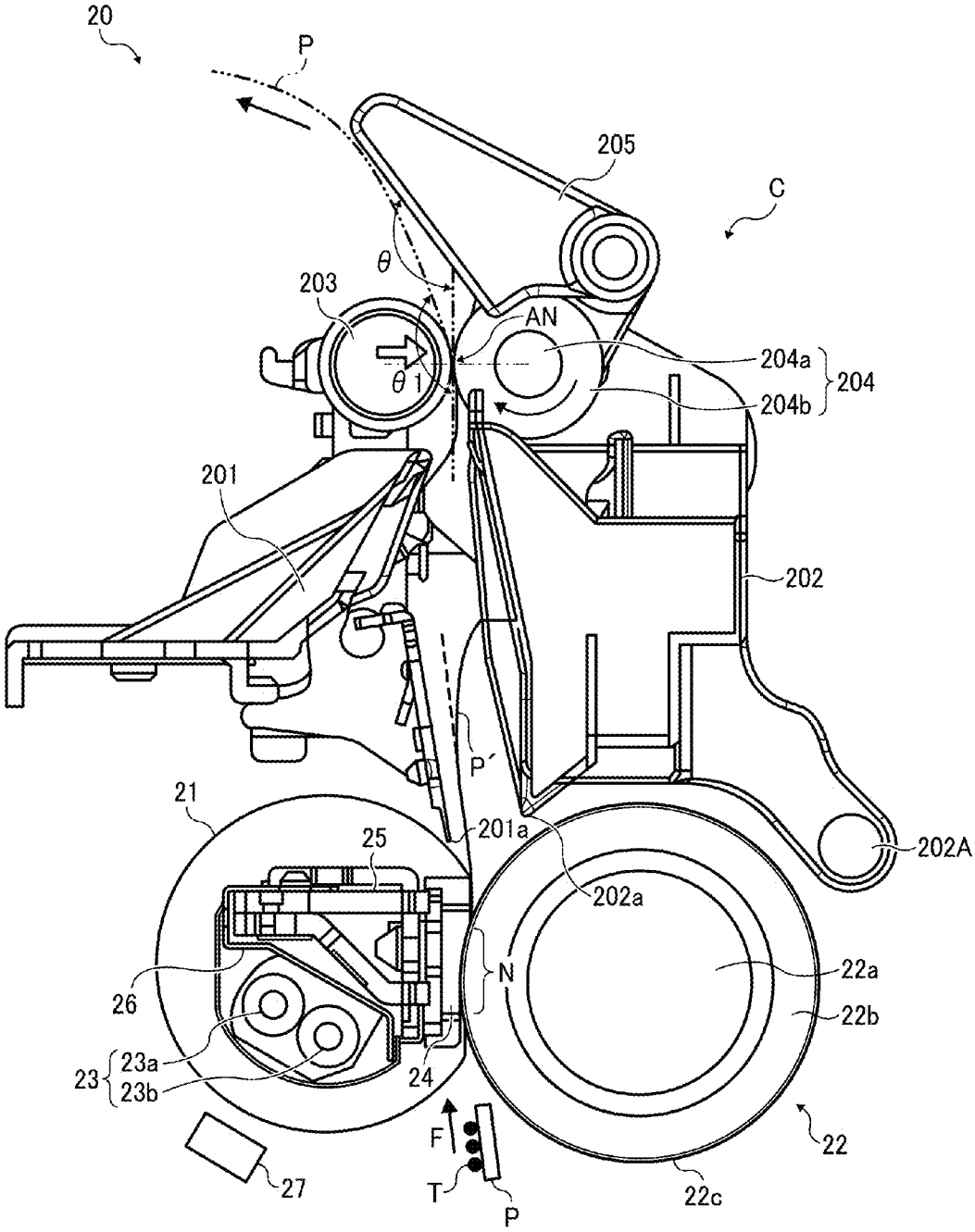
FIG. 2 illustrates a cross-sectional view of the fixing device according to one embodiment of the present invention.

FIG. 2 is a cross-sectional view of the fixing device including the back curl correction structure according to the embodiment of the present invention, As illustrated in FIG. 2, the fixing device 20 is used to fuse the toner image T onto the recording sheet P after the transfer process with heat and pressure. That is, the fixing device 20 causes the recording sheet P on which the toner image is transferred in the image forming section A to pass through the fixing nip N and fixes the toner image onto the recording sheet P with heat and pressure in the fixing nip N.

The fixing device 20 includes a flexible, endless fixing belt 21 that endlessly moves while being heated and a pressure roller 22 in addition to the endless fixing belt 21, serving as a fixing member. The pressure roller 22, serving as a pressure member, is rotatably disposed opposite the fixing belt 21 and forms the fixing nip N by applying pressure to the fixing belt 21 while contacting the fixing belt 21. A heater or a heat source 23 including a plurality of halogen lamps 23*a* and 23*b* is disposed inside the loop formed by the fixing belt 21 and heats an interior side of the fixing belt 21 everywhere except at the fixing nip N.

Inside the looped fixing belt 21 are disposed a nip forming member 24, a base member, a stay 25 to support the nip forming member 24, a reflecting member 26 to reflect light radiated from the heater 23 and onto the fixing belt 21. The nip forming member 24 serves as a base member for forming a nip and includes a friction sheet (a low-friction sheet) wound around the base pad.

Although the fixing nip N of the nip forming member 24 as illustrated in FIG. 2 has a planar shape, the shape of the fixing nip N is not limited thereto. For example, if the fixing nip portion N is formed to have a concave shape along a peripheral surface of the pressure roller 22, a leading end of the recording sheet P which passes through the fixing nip portion N comes to a side of the pressure roller 22, thereby improving separability of the recording sheet P from the fixing belt 21.

The temperature of the fixing belt 21 is detected by a temperature sensor 27 disposed on a side where the recording sheet P enters the fixing nip portion, and is used to control the heater 23. In FIG. 2, an arrow F shows a direction along which the recording sheet P is fed.

The fixing belt 21 is an endless belt formed in a thin, flexible sleeve shape, and includes a base material and a release layer disposed on a surface of the base material. Examples of the base material include metals such as nickel or A-SUS or resin materials such as polyimide. Examples of materials for the release layer having a releasability relative to the toner include copolymer of tetrafluoroethylene-perfluoroalkyl vinylether (PFA) or polytetrafluoroethylene (PTFE).

The pressure roller 22 includes a metal core 22*a;* an elastic layer 22*b* disposed on the metal core 22*a*, formed of the foamed silicon rubber, the silicon rubber, or the fluororubber; and the release layer disposed on the surface of the elastic layer 22*b* and formed of PFA or PTFE. The pressure roller 22 is pressed against the fixing belt 21 by a pressure member, and is contacted to the nip forming member 24 as a base member via the fixing belt 21.

The elastic layer 22*b* of the pressure roller 22 is squeezed at a portion where the pressure roller 22 and the fixing belt 21 contact each other, so that the nip forming member 24 forms the fixing nip portion N with a predetermined width due to the pressure between the fixing belt 21 and the pressure roller 22.

The pressure roller 22 is configured to rotate by a driving source such as a motor disposed in the printer body. Further, when the pressure roller 22 is driven to rotate, the driving force of the pressure roller 22 is transmitted to the fixing belt 21 at the fixing nip portion N, so that the fixing belt 21 is rotated as well.

In the fixing device 20 according to the present embodiment, the pressure roller 22 is configured as a solid-core roller, but may be a hollow roller. When the pressure roller 22 is a hollow roller, a heat source such as a halogen heater using radiation heat may be disposed inside the pressure roller 22. If the pressure roller 22 does not include an elastic layer, the thermal capacity of the pressure roller 22 is reduced and the fixing property is improved. However, when the unfixed toner is pressed and fixed, minute concavity and convexity of the belt surface is transferred to the image and the solid image portion may include uneven glossiness. To prevent such uneven glossiness of the image, an elastic layer with a thickness of 100 μm or more is desired.

Examples of materials for a pipe-shaped metal to be used for the hollow roller include iron or stainless steel. When a heat source is disposed inside the pressure roller 22, a heat insulation layer need be disposed on a surface of a substrate, or alternatively, a heat ray reflection surface need be provided by mirror finishing, to thereby prevent the substrate from being heated by the radiation heat from the heat source. In addition to the above-described halogen heater, an IH heater, a resistance heat generator, or a carbon heater can be used for the heat source.

Because the above fixing device 20 employs a structure to directly heat the low-thermal capacity heating member, a temperature of the fixing device 20 increases very quickly and a first print can be obtained quickly. However, from the view of the back curl of the recording sheet P, because fixation is performed before the heat roller is fully heated, the difference in temperature between the front side and back of the recording sheet P causes back curl (that is, a curved shape of a solid line P' as illustrated in FIG. 2).

A separator/feeder device disposed at an outlet side of the recording sheet of the fixing device 20 separates the recording sheet P that has passed through the fixing nip portion N, in the vicinity of the fixing nip portion N and guides it to the ejection direction.

The separator feeder device includes a belt-side separator member 201 disposed on the side of the fixing belt 21 and a pressure-side separator member 202 disposed on the side of the pressure roller 22. The belt-side separator member 201 includes a tip end 201*a* adjacent to the fixing belt 21 downstream in a moving direction of the recording sheet P moving from the fixing nip portion. The pressure-side separator member 202 includes an oscillation end 202*a* adjacent to the pressure roller 22.

The belt-side separator member 201 peels the recording sheet P that tends to adhere to the fixing belt 21 off the fixing belt 21. Accordingly, the belt-side separator member 201 is preferably formed of a metal material for precise positioning so that the recording sheet P adhering to the fixing belt 21 can be peeled off from the surface of the fixing belt 21.

The pressure-side separator member 202 is formed of a resin mold and includes a support rod 202A disposed on a part thereof. The support rod 202A is rotatably supported at a side of the apparatus body, and the pressure-side separator member 202 oscillates such that the oscillation end 202*a* disposed opposite the pressure roller 22 can be contacted against and separated from the pressure roller 22.

The pressure-side separator member 202 oscillates relative to the pressure roller 22, and oscillates greatly in a direction separating from the pressure roller 22 when a jammed recording sheet P is removed from the fixing nip portion N, to provide room for maintenance to the fixing nip portion N to facilitate removal of the recording sheet P.

The back curl correction structure C, disposed between the branching member 15 and the fixing device 20, includes a drive roller 204, a driven roller 203, and a guide member 205. The drive roller 204 and the driven roller 203 are disposed downstream of the separator members 201 and 202. The drive roller 204 is disposed on a side where the recording sheet P generates a back curl in the fixing nip portion, that is, at a side of the pressure roller 22 in the sheet feeding path between the fixing device 20 and the branching member 15.

The driven roller 203 is disposed on a side where the recording sheet P is heated in the fixing nip portion, that is, at a side of the fixing belt 21 in the sheet feeding path between the fixing device 20 and the branching member 15.

The drive roller 204 and the driven roller 203 construct an auxiliary nip portion AN and rotate to guide the feeding of the recording sheet P. A distance between the fixing nip portion and the auxiliary nip portion is shorter than a length of the recording sheet P.

A structure to prevent a jam from occurring will be described.

A diameter of the drive roller 204 is greater than that of the driven roller 203. A feeding speed of the recording sheet in the auxiliary nip portion is slightly smaller than that of the recording sheet in the fixing nip portion. A nip pressure in the auxiliary nip portion is slightly smaller than that in the fixing nip portion. With this structure, a jam of the recording sheet P does not occur in the portion between the fixing nip portion and the auxiliary nip portion.

Preferably, at least a circumference of the roller of the drive roller 204 is formed of rubber and at least a circumferential surface of the roller of the driven roller 203 is harder than the circumferential surface of the roller of the drive roller 204 and has good releasability.

In the present embodiment, the drive roller 204 includes a metal core 204*a* (which corresponds to a roller shaft 204*a*) and a solid rubber material 204*b*, having a higher wear coefficient, disposed on the surface of the metal core 204*a*, and obtains performance to feed the recording sheet. Exemplary materials for the solid rubber material 204*b* include silicon, EPDM, urethane, and fluorine rubber.

The driven roller 203 includes a hollow pipe-shaped metal and a tube formed of PFA, ETFA, or FEP with a small depth from 30 μm to 300 μm that covers a surface of the metal pipe.

During fixation, water vapor is generated from the paper and condenses. The hollow pipe-shape metal is used to prevent dew condensation from adhering to the driven roller, because the hollow metal pipe has a low thermal capacity, and is heated quickly by the heat from the fixing device.

A tube having a small depth is disposed on the surface of the metal pipe to prevent a small amount of toner that has not melted during the fixation from adhering to the tube, and further, from accumulating thereon even though a certain amount of toner is adhered. Specifically, the driven roller 203 feeds the recording sheet P while constantly contacting the surface on which the image is formed, of the recording sheet P as described heretofore. The driven roller 203 is held to the body of the image forming apparatus by a spring via a holder, and the holder is pressed by the spring, so that the drive roller 204 and the driven roller 203 contact each other to form an auxiliary nip portion and feed the recording sheet P forward.

The guide member 205 is so disposed to the fixing device as to coaxially rotate about the roller shaft 204*a* of the drive roller 204.

When positioned at the first position as illustrated in FIG. 2, the guide member 205 slidably contacts a front side of the recording sheet P in the feed direction passing through the auxiliary nip portion on the same side of the drive roller 204, so that the guide member 205 serves to bend the recording sheet P in a concave shape toward a side opposite the back curl of the recording sheet P.

Specifically, the guide member 205 when held at the first position, positions to disturb the path from the same side of the drive roller 204 relative to a direction of the recording sheet P passing through the auxiliary nip portion, which is a right angle to a line connecting each center of the pair of rollers.

Thus, the leading end of the recording sheet P contacts the guide member 205 to form a contact angle θ as illustrated in FIG. 2. The recording sheet P then is pressed by the guide member 205 and fed by the nip feed force between the drive roller 204 and the driven roller 203.

As a result, the guide member 205 ultimately feeds the recording sheet P applying a contact angle θ1 with the auxiliary nip portion set as a starting point, so that the recording sheet P bends to form a concave surface at a side opposite the back curl to provide hack curl correction. By providing such a feeding path, the back curl generated in the fixation of the recording sheet P is ameliorated while the recording sheet is passing through the guide member 205, and the recording sheet P is ejected to the sheet ejection tray 14.

Thus, in the back curl correction structure C, the rotary drive force of the pressure roller 22 is ultimately transmitted to the drive roller 204 to thus feed the recording sheet P in the auxiliary nip portion, and the guide member 205 bends the recording sheet P in a direction opposite that of the hack curl. Accordingly, the recording sheet P is fed out from the guide member 205 with a back curl generated in the fixation ameliorated.

Figure 3:
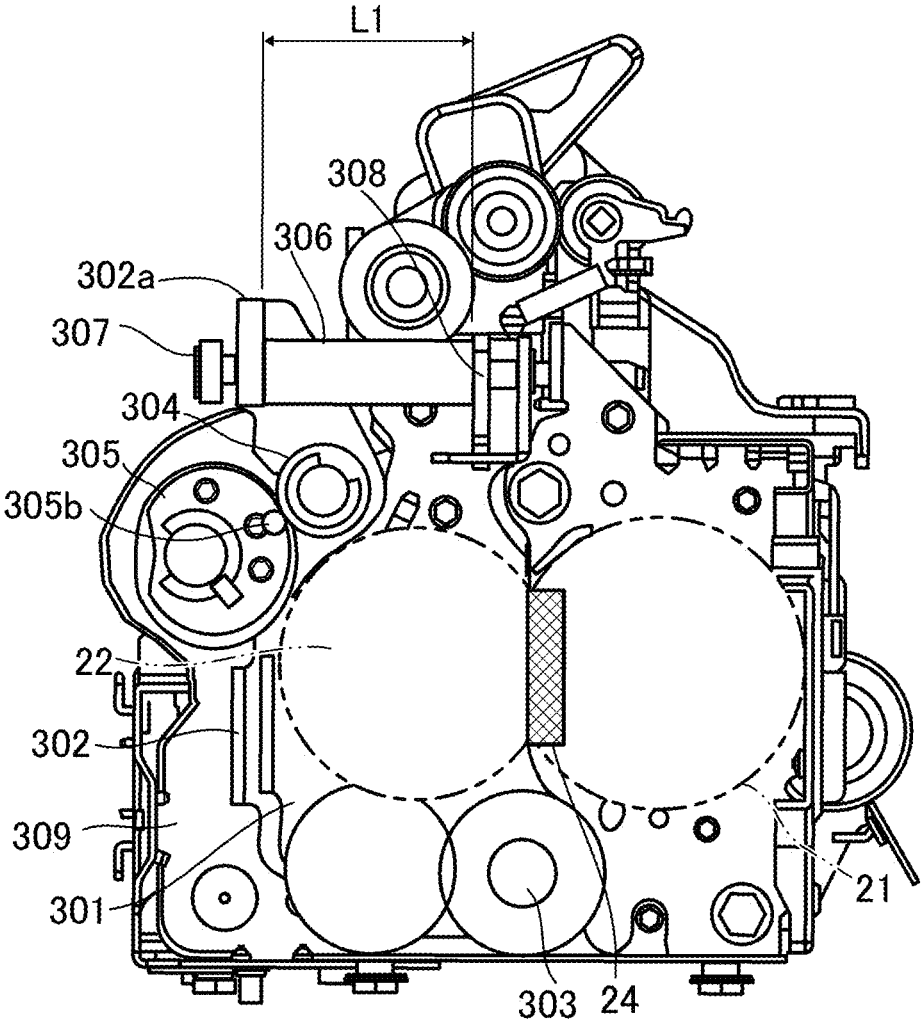
FIG. 3 illustrates a side view of a release structure when pressure is applied, according to one embodiment of the present invention.

As illustrated in FIG. 3, when the pressure is applied in the release structure, the pressure roller 22 presses against the fixing belt 21 and the nip forming member 24 with a pressure necessary for transferring the toner image onto the recording sheet, and a printing process goes on.

Figure 4:
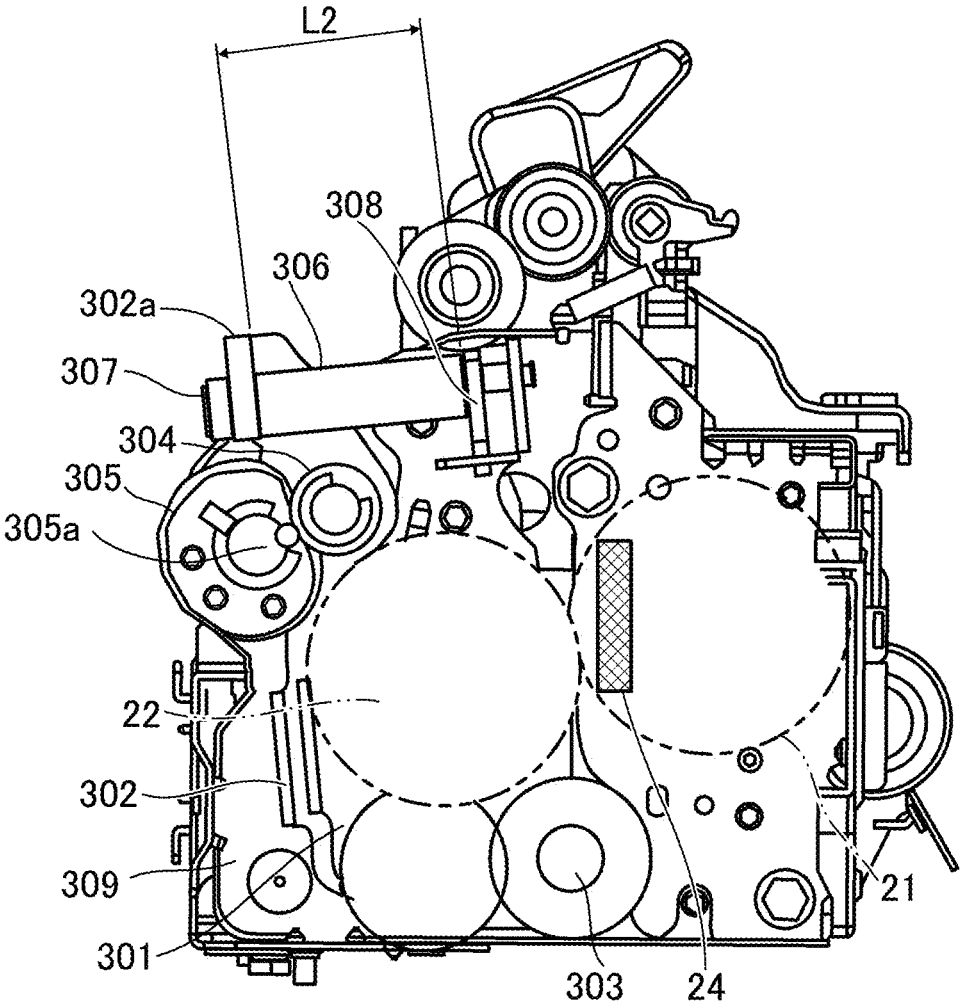
FIG. 4 illustrates a side view of a release structure when released according to one embodiment of the present invention.

As illustrated in FIG. 4, when the pressure is released in the release structure, the pressing force of the pressure roller 22 is released and a printing process is suspended to enable someone to remove a jammed sheet caught between the pressure roller 22 and the fixing belt 21 or to relax compression strain of the elastic layer 22*b* of the pressure roller 22 in the non-printing process.

The pressure roller 22 is axially supported by an arm 301. The arm 301 is oscillated about a rotary center shaft 303. A cam 305 is rotatably disposed on a frame 309 on which the rotary center shaft 303 is disposed. A cam follower 304 is rotatably disposed on an arm 302. The arm 302 is oscillated about the rotary center shaft 303 similarly to the arm 301. The release structure is secured to a drive unit and is disposed such that the cam 305 contacts the cam follower 304 at bottom dead center 305*a* in a released state.

Upon receiving a print start signal from a controller, the release structure is rotated by a drive source such that the cam 305 contacts the cam follower 304 at top dead center 305*b*, and is secured. The arm 302 rotates clockwise about the rotary center shaft 303 in FIG. 3.

Due to operation of the arm 302, a press spring stopper 302*a* disposed on the arm 302 pushes a press spring 306 to a compressing direction.

The press spring screw 307 passes through an internal diameter portion of the press spring 306, and is secured to an adjustment plate 308 with screws. Another end of the press spring screw 307 is secured to the arm 301. Thus, an operation of the arm 302 is sequentially transmitted to the press spring stopper 302*a*, the press spring 306, the adjustment plate 308, the press spring screw 307, the arm 301, and to the pressure roller 22.

The pressure roller 22 is disposed opposite the nip forming member 24 with the fixing belt 21 in between, and presses the fixing belt 21 at a predetermined pressure. With this structure, the elastic layer 22*b* of the pressure roller 22 is compressed, thereby forming a fixing nip portion N.

In this case, a total length L1 of the press spring 306 when the pressure is applied in the release structure as illustrated in FIG. 3 is shorter than a total length L2 of the press spring 306 when the pressure is released in the release structure as illustrated in FIG. 4. Specifically, the pressing force used to press the pressure roller 22 is (L2-L1) multiplied by a constant of the spring.

Because the adjustment plate 308 is secured to the press spring screw 307 with a screw, a distance between the adjustment plate 308 and the press spring stopper 302*a* can be changed arbitrarily, and the pressing force of the press spring 306 relative to the pressure roller 22 can be adjustable.

Figure 5:
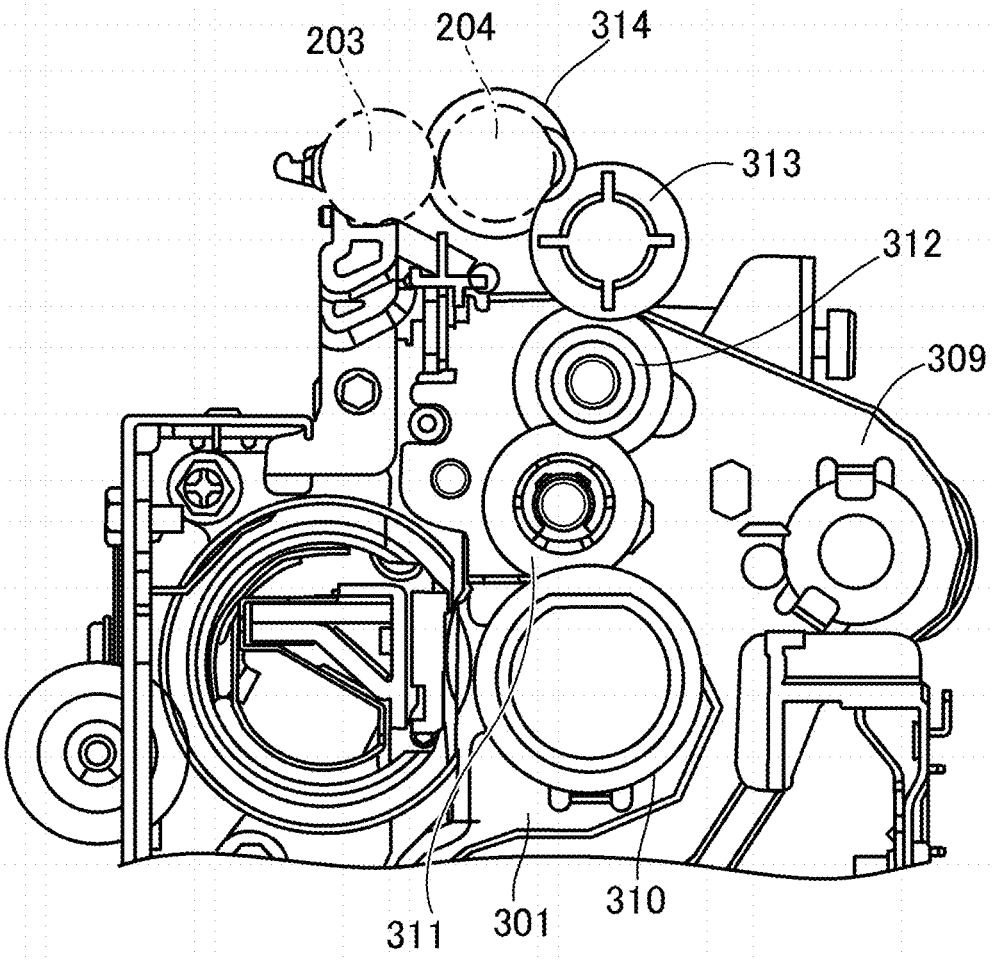
FIG. 5 illustrates a side view of a drive roller when pressure is applied according to one embodiment of the present invention.

As illustrated in FIG. 5, when the drive roller 204 is pressed, the pressure roller gear 310 disposed at an end of the pressure roller 22 is driven to rotate in synchronization with the pressure roller 22, Specifically, the shafts of the pressure roller 22 and the drive roller 204 are engaged with gear rows including the pressure roller gear 310, an idler gear 311, a pressure roller side connection gear 312, and a drive roller side connection gear 313, so that the rotational force of the pressure roller 22 is transmitted to the drive roller 204.

The pressure roller side connection gear 312 axially supports both ends of the pressure roller 22 and is disposed to the arm 301 that allows the pressure roller 22 to rotate between a. pressurized state and a released state.

Figure 6:
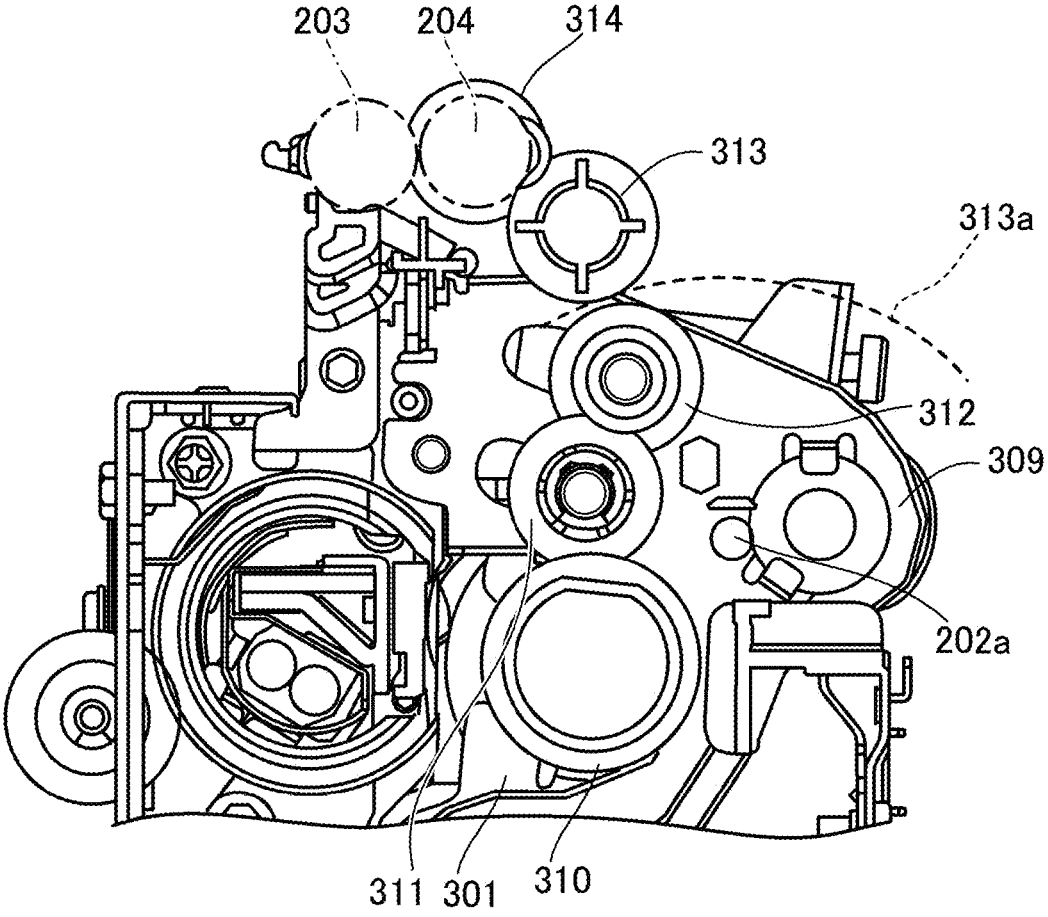
FIG. 6 illustrates a side view of the drive roller when released according to one embodiment of the present invention.

As illustrated in FIG. 6, the drive roller side connection gear 313 is disposed on the guide member 205 that axially supports the drive roller 204, and the guide member 205 is rotatably secured, such that the pressure roller side connection gear 312 in a released state is not disposed, and does not interfere with, along a rotary moving locus of the drive roller side connection gear 313 when the drive roller 204 is released.

The pressure roller 22 is rotated by a pressure roller drive source. The idler gear 311 and the pressure roller side connection gear 312 is rotatably disposed on the arm 301.

Because the pressure roller 22 is rotatably secured to the arm 301, the pressure roller gear 310, the idler gear 311, and the pressure roller side connection gear 312, while keeping a distance between adjacent shafts, operate simultaneously with the arm 301.

On the other hand, the drive roller side connection gear 313 and a drive roller gear 314 are supported by a pressure-side separation feeder 202, and the drive roller 204 rotates by receiving a drive transmission of the pressure roller 22 when the pressure is given (during a printing operation).

Thus, because the drive roller 204 rotates due to the drive transmission of the pressure roller 22, the rotational operation of the both is synchronized. As a result, no stress or loosening beyond necessity is given to the recording sheet, thereby stabilizing feeding property of the recording sheet P.

Figure 7:
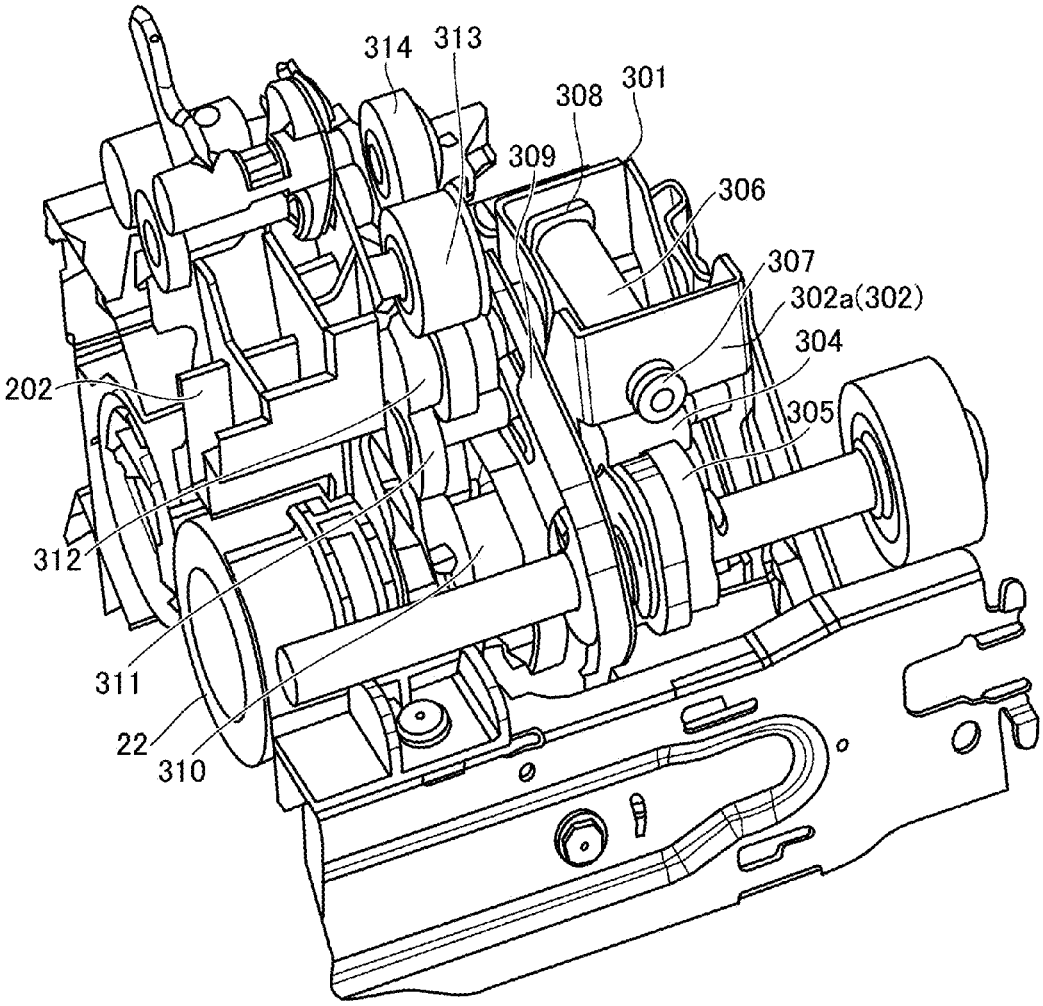
FIG. 7 is a perspective view of an internal structure of the fixing device according to one embodiment of the present invention.

The arm 301 of the release structure as illustrated in FIG. 7 rotates about the rotary center shaft 303 as illustrated in FIG. 5 when shifting from the pressing state in FIG. 5 to the released state in FIG. 6 and vice versa.

Because the pressure roller gear 310, the idler gear 311, and the pressure roller side connection gear 312 are disposed on the arm 301, and rotate simultaneously with the arm 301.

On the other hand, the drive roller side connection gear 313 and a drive roller gear 314 are disposed on the pressure-side separation feeder 202, and no positional change occurs without opening a cover of the image forming apparatus. Thus, the pressure roller side connection gear 312 and the drive roller side connection gear 313 are separated.

Releasing the pressure roller 22 makes it easy to remove jammed paper nipped between the fixing belt 21 (or nip forming member 24) and the pressure roller 22. However, because a rotational load of the drive roller 204 is still heavy, the jammed paper nipped between the drive roller 204 and the driven roller 203 cannot be removed easily. Accordingly, the pressure-side separation feeder 202 is configured to rotate about the support rod 202*a*. Thus, the pressure-side separation feeder 202 can be open and the jammed paper can be removed easily.

Figure 8:
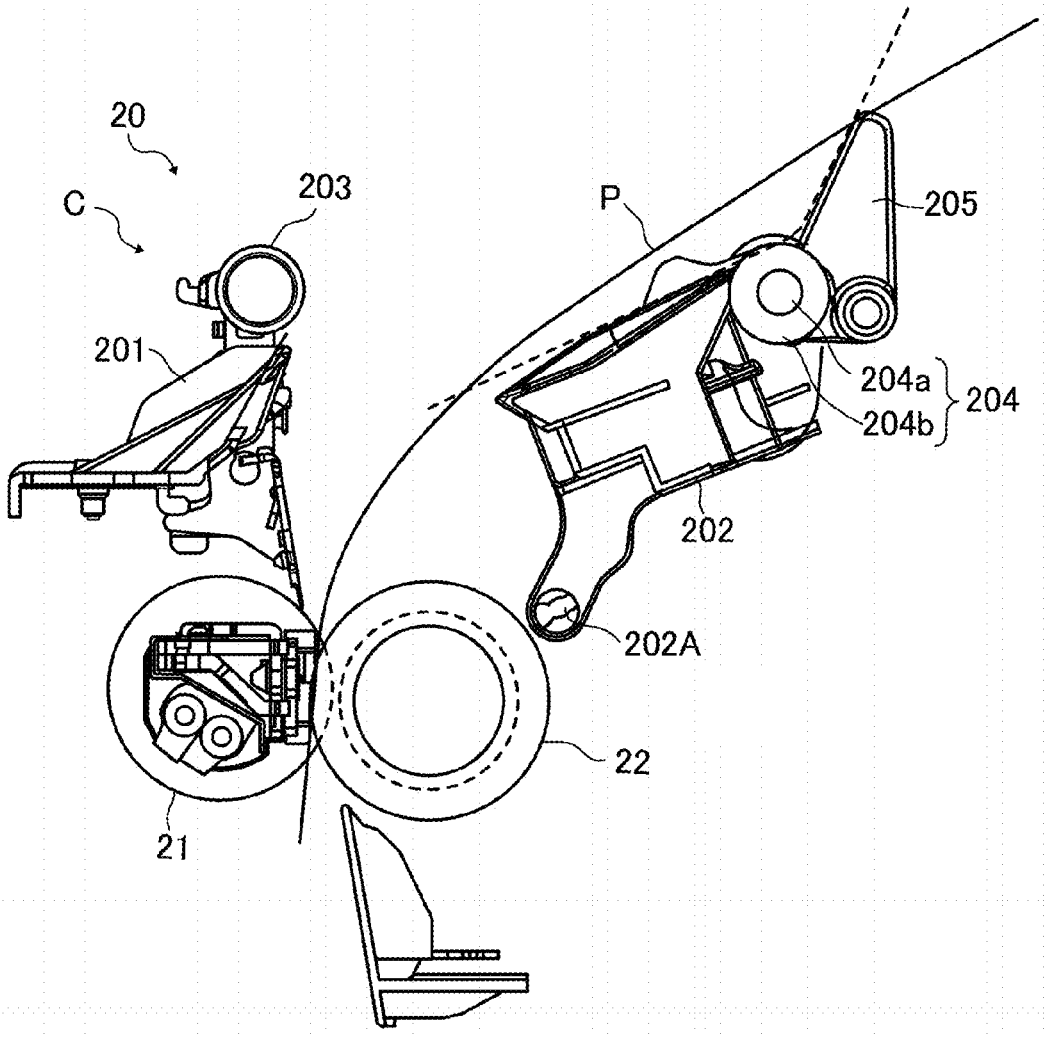
FIG. 8 is a side view of the fixing device according to one embodiment of the present invention.

FIG. 8 illustrates the drive roller side connection gear 313 disposed on the pressure-side separation feeder 202, in which the pressure-side separation feeder 202 is open in a released state.

As illustrated in FIG. 6, in a released state, the pressure roller side connection gear 312 in a released state is not disposed on a rotational moving locus 313*a* of the drive roller side connection gear 313. As a result, when the pressure-side separation feeder 202 is open, the open and close force is reduced, so that damage of the connection gears can be prevented effectively.

As described above, the pressure roller 22 forms a release structure for the nip forming member 24 and the fixing belt 21 to shift the pressing state to the release state in which the pressing state is relaxed. In the released state of the pressure roller 22, the driving connection of the drive roller 204 and the pressure roller 22 is released by a separation between the pressure roller side connection gear 312 and the drive roller side connection gear 313.

Further, as described above, the pressure roller side connection gear 312 axially supports both ends of the pressure roller 22 and is disposed to the arms 301 and 302 that allow the pressure roller 22 to rotate between a pressurized state and a released state.

Further, as described above, the drive roller side connection gear 313 is disposed on the guide member 205 that axially supports the drive roller 204. The guide member 205 is rotatably secured, and the pressure roller side connection gear 312 in the released state is not disposed along the rotational moving locus of the drive roller side connection gear 313.

Specifically, the fixing device 20 according to the above-described embodiment of the present invention is configured such that the recording sheet feeding speed in the auxiliary nip portion is slightly greater than the recording sheet feeding speed in the fixing nip portion, the nip force in the auxiliary nip portion is smaller by a predetermined amount than the nip force in the fixing nip portion, and the pressure roller 22 rotates in synchronization with the drive roller 204 in printing operation.

Accordingly, the fixing device 20 according to the above-described embodiment of the present invention can solve the following problem: That is, when the pressure roller 22 continues to rotate due to inertia of the driving system including the drive source even though the pressure roller 22 is stopped, and the rotary speed of the pressure roller is different from that of the drive roller 204, the recording sheet P nipped by the fixing device 20 and the drive roller 204 tends to be loosened or cut by a tension due to difference in the sheet feeding speed in the fixing nip portion and the sheet feeding speed in the auxiliary nip portion.

The fixing device 20 according to the above-described embodiment of the present invention is configured such that the drive roller 204 receives a driving rotation force from the pressure roller 22, so that the pressure roller 22 rotates in synchronization with the drive roller 204 in printing operation. As a result, regardless of the change in the driving state of the drive system, the sheet feeding speed in the fixing nip portion and the sheet feeding speed in the auxiliary nip portion are kept constant, thereby obtaining a stable sheet feeding property and preventing the recording sheet P nipped in the fixing nip portion and the auxiliary nip portion from being loosened to have winkles or being cut.

In addition, the fixing device 20 according to the embodiment of the present invention is configured such that the pressure roller 22 includes a release structure to allow the nip forming member 24 and the fixing belt 21 to shift from the pressurized state to the released structure, in which the driving connection of the drive roller 204 and the pressure roller 22 is released when the pressure roller 22 is released, by a separation between the pressure roller side connection gear 312 and the drive roller side connection gear 313, and the released sate of the pressure roller 22 and the release of the drive connection with the drive roller 204 are synchronized, to thereby reduce a job load for jammed paper.

When the printing is suspended, that is, in the released time, the user removes jammed paper. Accordingly, the pressure roller 22 and the drive roller 204 are driven to reduce the load of the user to remove the recording sheet, and the jammed paper is prevented from being cut and the drive gears are prevented from being damaged.

The fixing device 20 according to the embodiment of the present invention is configured such that the drive roller side connection gear 313 is disposed on the guide member 205 (e.g., guide plate) that axially supports the drive roller 204, the guide member 205 is rotatably secured, and the pressure roller side connection gear 312 in the released state is not disposed along the rotation moving locus of the drive roller side connection gear 313.

Thus, the fixing device 20 according to the embodiment of the present invention is configured such that the pressure roller side connection gear 312 axially supports both ends of the pressure roller 22, and is disposed on the arm 301 that rotates the pressure roller 22 from the pressurized state to the released state, so that, using an operation of the arm 301 to cause the pressure roller side connection gear 312 to be operated, the pressure roller side connection gear 312 and the drive roller side connection gear 313 are separated in association with the operation of the release structure, the pressure roller side connection gear 312 can be retracted from the drive roller side connection gear 313. With this structure, the pressure roller side connection gear 312 can be retracted from the drive roller side connection gear 313, so that the open and close of the guide member 205 can be made with ease and the jammed paper removal operation can be improved.

The image forming apparatus 1 according to the above-described embodiment of the present invention employs the fixing device 20 and the same optimal effect as in the fixing device 20 can be obtained.

According to embodiments of the present invention, regardless of the driving status of the drive system, the recording sheet feeding speed in the fixing nip portion and the recording sheet feeding speed in the auxiliary nip portion can be maintained at constant, a stable sheet feeding property can be obtained, and the present invention is generally useful for the fixing device and the image forming apparatus employing electrophotography such as a copier, facsimile machine, and a printer.

Additional modifications and variations of the present invention are possible in light of the above teachings. It is therefore to be understood that, within the scope of the appended claims, embodiments of the invention may be practiced other than as specifically described herein.

What is claimed is:

1. A fixing device comprising:

a flexible endless fixing member;

a heater to heat the fixing member;

a nip forming member to contact the fixing member directly or via a slide member;

a pressure member, rotatably disposed opposite the fixing member and the nip forming member, to press the fixing member to thereby form a fixing nip portion together with the nip forming member, wherein the fixing device fixes an image in the fixing nip portion with heat and pressure onto a recording sheet;

a back curl correction structure disposed downstream of and adjacent to the fixing nip portion in a recording sheet feeding direction, the back curl correction structure including:

a drive roller disposed on a side where a back curl appears in the recording sheet;

a driven roller disposed opposite the drive roller;

an auxiliary nip portion between the drive roller and the driven roller to feed the recording sheet; and a guide member disposed at the same side as the drive roller relative to the auxiliary nip portion to guide the recording sheet fed out from the auxiliary nip portion to bend in a direction opposite a curled direction of the back curl of the recording sheet, a drive roller side connection gear to input a rotary driving force to a rotary shaft of the drive roller; and a pressure member side connection gear to branch and output the rotary driving force of the pressure member, a driving connection between the drive roller and the pressure member being performed by a connection between the drive roller side connection gear and the pressure member side connection gear;

wherein the pressure member includes a release structure to shift the nip forming member and the fixing member between a pressurized state and a released state in which the pressurized state is relaxed, and wherein the driving connection between the drive roller and the pressure member is released when the pressure member is released, by separation between the pressure member side connection gear and the drive roller side connection gear.

2. The fixing device according to claim 1, further comprising an arm to rotate the pressure member to shift between a pressurized state and a released state, wherein the pressure member side connection gear axially supports both ends of the pressure member and is disposed on the arm.

3. The fixing device according to claim 1, wherein:

the drive roller side connection gear is disposed on the guide member that axially supports the drive roller;

the guide member is rotatably secured; and the pressure member side connection gear in the released state is not disposed on a rotation moving locus of the drive roller side connection gear.

4. An image forming apparatus comprising the fixing device according to claim 1.

5. The fixing device as recited in claim 1 wherein an axis of the drive roller side connection gear is configured to arcuately shift in synchronization with rotation of the pressure member side connection gear.

6. The fixing device as recited in claim 1 wherein the pressure roller side connection gear and the drive roller side connection gear are disposed on a pressure side separator member.

7. The fixing device as recited in claim 6 wherein the pressure roller side connection gear and the drive roller side connection gear are configured to rotate about an axis common with an axis of the pressure side separator member.

8. The fixing device as recited in claim 1 wherein the release structure comprises a cam and cam follower assembly.

* * * * *